US011339771B2

(12) United States Patent
Kitagawa

(10) Patent No.: US 11,339,771 B2
(45) Date of Patent: May 24, 2022

(54) FUEL INJECTION PUMP

(71) Applicant: DENSO CORPORATION, Kariya (JP)

(72) Inventor: Yuji Kitagawa, Kariya (JP)

(73) Assignee: DENSO CORPORATION, Kariya (JP)

( * ) Notice: Subject to any disclaimer, the term of this patent is extended or adjusted under 35 U.S.C. 154(b) by 144 days.

(21) Appl. No.: 16/749,115

(22) Filed: Jan. 22, 2020

(65) Prior Publication Data

US 2020/0240401 A1 Jul. 30, 2020

(30) Foreign Application Priority Data

Jan. 25, 2019 (JP) ..... JP2019-011162

(51) Int. Cl.

| | |
|---|---|
| ***F04B 53/16*** | (2006.01) |
| ***F04B 19/04*** | (2006.01) |
| ***F02M 59/02*** | (2006.01) |
| *B04C 5/04* | (2006.01) |
| *F04B 49/22* | (2006.01) |

(52) U.S. Cl.

CPC ..... *F04B 19/04* (2013.01); *F02M 59/027* (2013.01); *F04B 53/16* (2013.01); *B04C 5/04* (2013.01); *F04B 49/225* (2013.01)

(58) Field of Classification Search

CPC ..... F04B 53/16; F04B 49/042–045; F04B 9/042–045; F04B 53/00; F04B 49/225; F02M 37/043; F02M 59/027; B04C 5/04

See application file for complete search history.

(56) References Cited

U.S. PATENT DOCUMENTS

| | | | | |
|---|---|---|---|---|
| 4,138,931 A * | 2/1979 | Hermann | ..... | F04B 13/02 222/409 |
| 4,634,351 A * | 1/1987 | Leonard | ..... | F04B 43/06 417/395 |
| 2005/0098159 A1 | 5/2005 | Nishiwaki | | |
| 2009/0126695 A1* | 5/2009 | Vu | ..... | F04B 53/102 123/495 |

FOREIGN PATENT DOCUMENTS

| | | |
|---|---|---|
| JP | 2018-87548 | 6/2018 |

* cited by examiner

*Primary Examiner* — Devon C Kramer
*Assistant Examiner* — Thomas Fink
(74) *Attorney, Agent, or Firm* — Nixon & Vanderhye P.C.

(57) ABSTRACT

A fuel injection pump includes a cylinder formed with a passage of fuel, a plunger, and a swirl flow generating par. The plunger slides along an inner wall of a sliding hole located in the cylinder and reciprocates between an uppermost point and a lowermost point to pressurize the fuel in a pressurizing chamber placed at an end of the sliding hole at a highest point. The plunger is movable downward to cause the pressurizing chamber to inhale the fuel from an intake passage in a fuel suction stroke. The intake passage is communicated to the pressurizing chamber at a lateral side of a plunger axis that is an axis of the plunger in a sliding direction. The swirl flow generating part guides the fuel to form a swirl flow around the plunger axis in the fuel suction stroke.

4 Claims, 12 Drawing Sheets

FUEL INJECTION PUMP

CROSS REFERENCE TO RELATED APPLICATION

The present application claims the benefit of priority from Japanese Patent Application No. 2019-011162 filed on Jan. 25, 2019. The entire disclosure of the above application is incorporated herein by reference.

TECHNICAL FIELD

The present disclosure relates to a fuel injection pump.

BACKGROUND

A known fuel injection pump pressurizes fuel that is inhaled to a pressurizing chamber by reciprocation of a plunger and discharges high pressure fuel.

SUMMARY

According to an aspect of the present disclosure, a fuel injection pump includes a cylinder that is formed with a passage of fuel and a plunger. An intake passage is communicated to a pressurizing chamber at a lateral side of a plunger axis that is an axis of the plunger in a sliding direction. The fuel injection pump further includes a swirl flow generating part, or an axis of the intake passage extends in a direction from an outside in a radial direction of the pressurizing chamber to the plunger axis and is inclined toward a lowermost position of the plunger.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
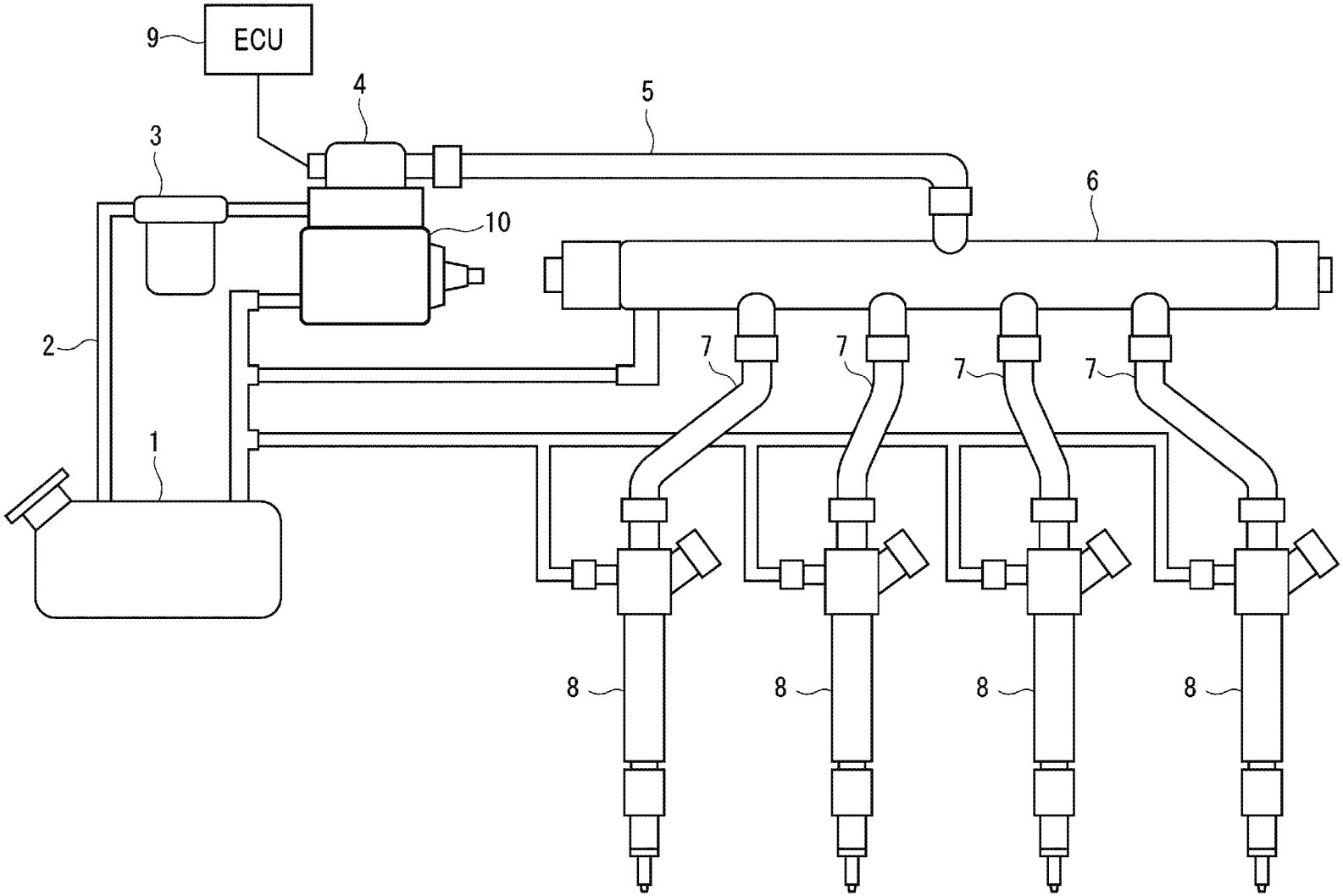
FIG. 1 is a diagram showing an overall structure of a common rail system to which a fuel injection pump is applied.

Hereinafter, one example of the present disclosure will be described.

According to the one example, a fuel injection pump pressurizes fuel that is inhaled to a pressurizing chamber by reciprocation of a plunger and discharges high pressure fuel. The fuel supply pump is a high pressure fuel supply pump. In a case where an intake valve opens during a fuel suction stroke, the fuel which has passed a damper chamber flows from an intake port into a pressurizing chamber through an opening of a seat part and a hole. The hole is formed in a pump body in a horizontal direction.

In an assumable configuration, the hole which is formed in the pump body in the horizontal direction communicates the intake valve to the pressurizing chamber. The hole is referred to as an intake passage in the present disclosure. An axis of the intake passage is orthogonal to an axis of a plunger in each of a cross section taken along an axial direction and a cross section taken along a radial direction of the plunger.

In the structure described in above, the fuel is inhaled from the intake passage into the pressurizing chamber during the fuel suction stroke. Subsequently, the fuel collides to an inner wall which faces to the intake passage and flows toward the plunger along the inner wall. Accordingly, the fuel is drawn with a pressure recovery in an upper part in the pressurizing chamber, and a flow of the fuel to surround the plunger is generated. Therefore, a local negative pressure could be generated around an upper end of the plunger at a side opposite to the intake passage in a circumferential direction.

According to one example of the present disclosure, a fuel injection pump restrains a local negative pressure in a pressurizing chamber during a fuel suction stroke.

The fuel injection pump includes a cylinder that is formed with a passage of fuel and a plunger. The plunger is configured to slide along an inner wall of a sliding hole located in the cylinder and to reciprocate between an uppermost point and a lowermost point to pressurize the fuel in the pressurizing chamber placed at an end of the sliding hole at a highest point. The plunger is movable downward to cause the pressurizing chamber to inhale the fuel from an intake passage in the fuel suction stroke. The intake passage is communicated to the pressurizing chamber at a lateral side of a plunger axis that is an axis of the plunger in a sliding direction.

The present disclosure includes three embodiments. A fuel injection pump in a first or a second embodiment further includes a swirl flow generating part configured to guide the fuel to form a swirl flow around the plunger axis in the fuel suction stroke. Due to this, a generation of the flow which flows to surround the plunger is restricted in the fuel when pressure is recovered in an upper area of the pressurizing chamber. Therefore, the local negative pressure around an upper end of the plunger is restricted.

In the first embodiment, an axis of the intake passage is shifted from a flat plane that includes the plunger axis. The intake passage intersects with the inner wall of the pressurizing chamber at a non-right angle at an eccentric inlet. The eccentric inlet is formed as the swirl flow generating part.

In the second embodiment, at least one inner wall recess is recessed outward in a radial direction at a part of the inner wall in the pressurized chamber in the circumferential direction. The at least one inner wall recess is placed at a position asymmetric with respect to the axis of the intake passage when viewed in a direction along the plunger axis. The at least one inner wall recess is formed as the swirl flow generating part.

In a third embodiment, an axis of the intake passage extends in a direction from an outside in a radial direction of the pressurizing chamber to the plunger axis and is inclined toward a lowermost position of the plunger. Due to this, fuel which is inhaled from the intake passage into the pressurizing chamber directly flows around the upper end of the plunger at a side opposite to the intake passage. Therefore, fuel which is drawn from the upper part is balanced with fuel which is supplied newly, and the local negative pressure may be restricted.

As follows, an embodiment of the present disclosure will be described with reference to FIGS. 1 to 12B. The same reference numerals are given to the same structures in multiple embodiments, and explanation thereof are eliminated. The first to third embodiments are referred to as a present embodiment, comprehensively. A fuel injection pump 10 in the present embodiment may be applied, for example, to a supply pump which compresses and sends high pressure fuel to a common rail in a common rail system of a diesel engine.

(Common Rail System)

First, an overall structure of the common rail system will be described with reference to FIG. 1. The common rail system includes a fuel tank 1, the fuel injection pump 10, a common rail 6, multiple fuel injection valves 8, and the like. Pipes connect those components. A low-pressure fuel pipe 2 connects the fuel tank 1 to a fuel injection pump 10. A fuel filter 3 is provided at an intermediate location of the low-pressure fuel pipe 2 and configured to remove foreign substance.

A pre-rail high-pressure fuel pipe 5 connects the fuel injection pump 10 to the common rail 6. Multiple post-rail high-pressure fuel pipes 7 connect the common rail 6 to the multiple fuel injection valves 8. The fuel injection pump 10 pressurizes low pressure fuel which is inhaled from the fuel tank 1 and supplies high pressure fuel to the common rail 6. A flow control valve 4 controls an amount of fuel which is to be inhaled into the fuel injection pump 10 according to an instruction from an ECU 9. Figures and descriptions for other signal lines which are input or output by the ECU 9 in the common rail system are omitted.

The high pressure fuel is supplied to the common rail 6 and distributed to the multiple fuel injection valves 8. In the example showing by FIG. 1, four fuel injection valves are provided. The fuel injection valve 8 injects the fuel to a cylinder of an engine. The fuel which is not supplied to the downstream of the fuel injection pump 10, the common rail 6, and the fuel injection valve 8, or which is not consumed by the injection returns to the fuel tank 1 through return pipes.

[Fuel Injection Pump]

Figure 2:
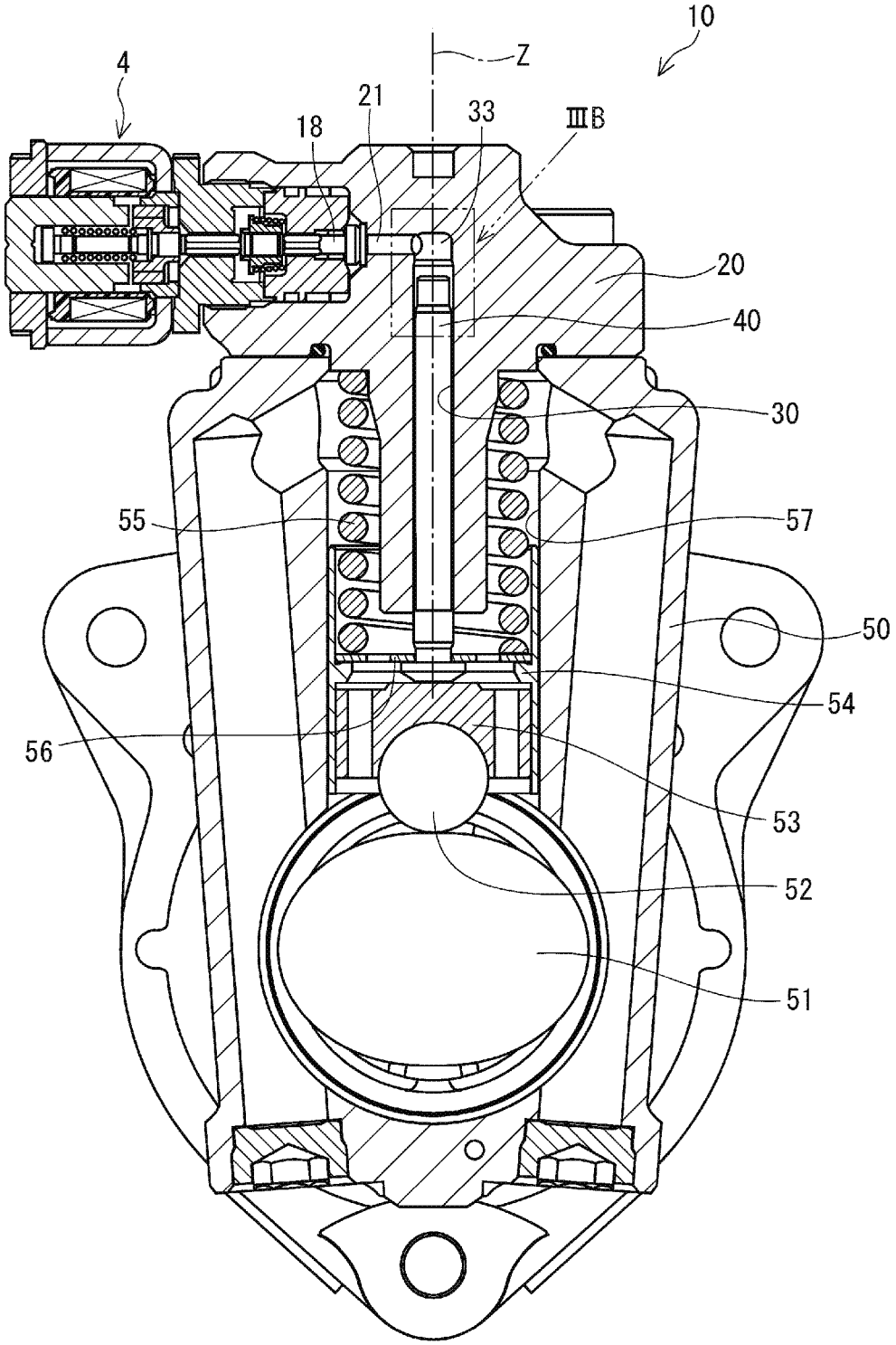
FIG. 2 is a sectional view showing an entirely of the fuel injection pump.

FIG. 2 shows an overall structure of the fuel injection pump 10. For convenience of explanation, in the description of a structure of the fuel injection pump 10, an upper side of FIG. 2 is referred to as "upper" while a lower side in FIG. 2 is referred to as "lower" hereinafter. However, in a state where the fuel injection pump 10 is equipped under an actual condition, the upper or lower direction in Figures may not be coincide with a vertical direction.

A housing 50 of the fuel injection pump 10 includes a cam 51, a roller 52, a shoe 53, a tappet 54, a return spring 55, a seat 56, and the like, as a driving mechanism of a plunger 40. The cam 51 rotates with an unillustrated camshaft. The roller 52 is supported by the shoe 53 rotatably and abuts against a surface of the cam 51. The rotation of the cam 51 is transmitted to the tappet 54 through the roller 52 and the shoe 53. The tappet 54 reciprocates along a driving wall 57. The return spring 55 biases the tappet 54 to the cam 51 through the seat 56 which is connected to a lower end of the plunger 40.

In the case where the cam 51 rotates such that a contact point with the roller 52 moves from a minor axis side to a major axis side, the tappet 54 is moved upward against a biasing force of the return spring 55, and accordingly, the plunger 40 is moved upward. In the case where the cam 51 rotates such that the contact point with the roller 52 moves from the major axis side to the minor axis side, the tappet 54 is moved downward by the biasing force of the return spring 55, and accordingly, the plunger 40 is moved downward.

A cylinder 20 is placed at the upper part of the housing 50 and includes a passage of fuel. The driving mechanism in the above enables the plunger 40 to reciprocate and to slide between the uppermost point and the lowermost point along an inner wall of a sliding hole 30 which is located in the cylinder 20. The plunger 40 moves upward and pressurizes the fuel in a pressurizing chamber 33 which is placed at an end of the sliding hole 30 on the uppermost point.

An intake valve 18 is provided at an upstream of a pressurizing chamber 33 and controlled to open or close by the metering valve 4. An intake passage 21 is located in the cylinder 20 and communicates the intake valve 18 to the pressurizing chamber 33. A discharge passage and a discharge valve are provided at a downstream of the pressurizing chamber 33 in a cross section which is different from that in FIG. 2. The high pressure fuel which has been pressurized in the pressurizing chamber 33 is discharged to the discharge passage. The discharge valve opens and closes the discharge passage.

The fuel injection pump 10 of this type repeats a fuel suction stroke, a pressurizing stroke, and a discharge stroke by a reciprocation of the plunger 40, operations of the intake valve 18 and the discharge valve, and the like. By repeating the fuel suction stroke, the pressurizing stroke, and the discharge stroke, the fuel which is inhaled is pressurized and sent to the common rail 6. In the fuel suction stroke, the plunger 40 is moved downward, and the fuel is inhaled from the intake passage 21 to the pressurizing chamber 33. The axis along which the plunger slides is referred to as a plunger axis Z hereinafter. The intake passage 21 is communicated to the pressurizing chamber 33 at a lateral side of the plunger axis Z. This configuration is common to multiple embodiments and a comparative example.

Figure 3A:
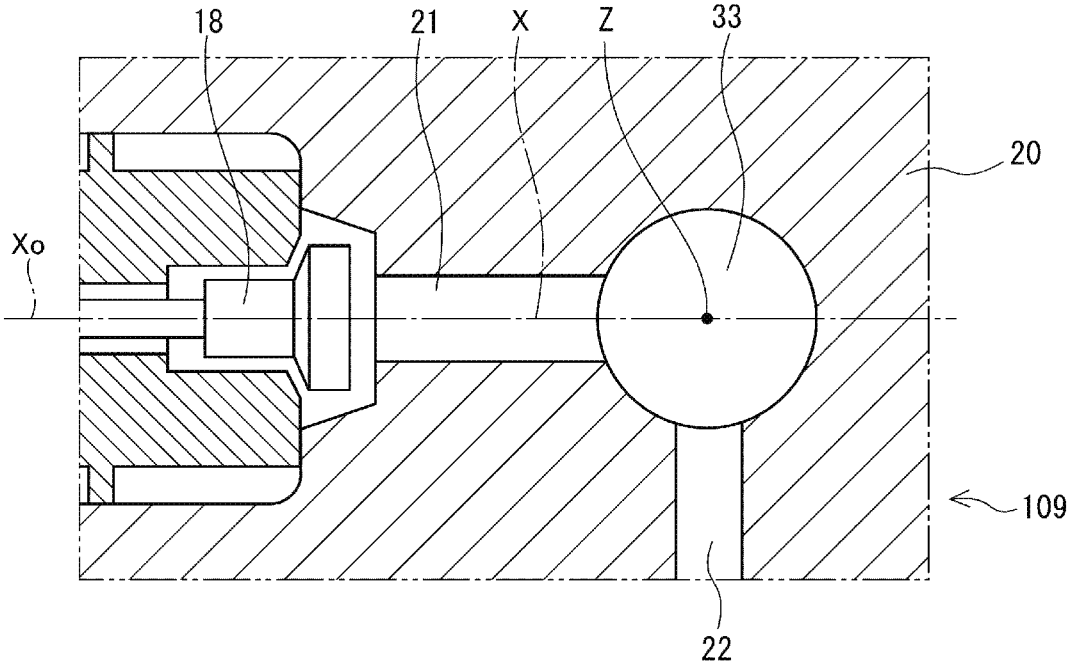
FIG. 3A is a sectional view showing a fuel injection pump taken along a radial direction of a plunger that is along a line IIIA-IIIA in FIG. 3B in a comparative example.
Figure 3B:
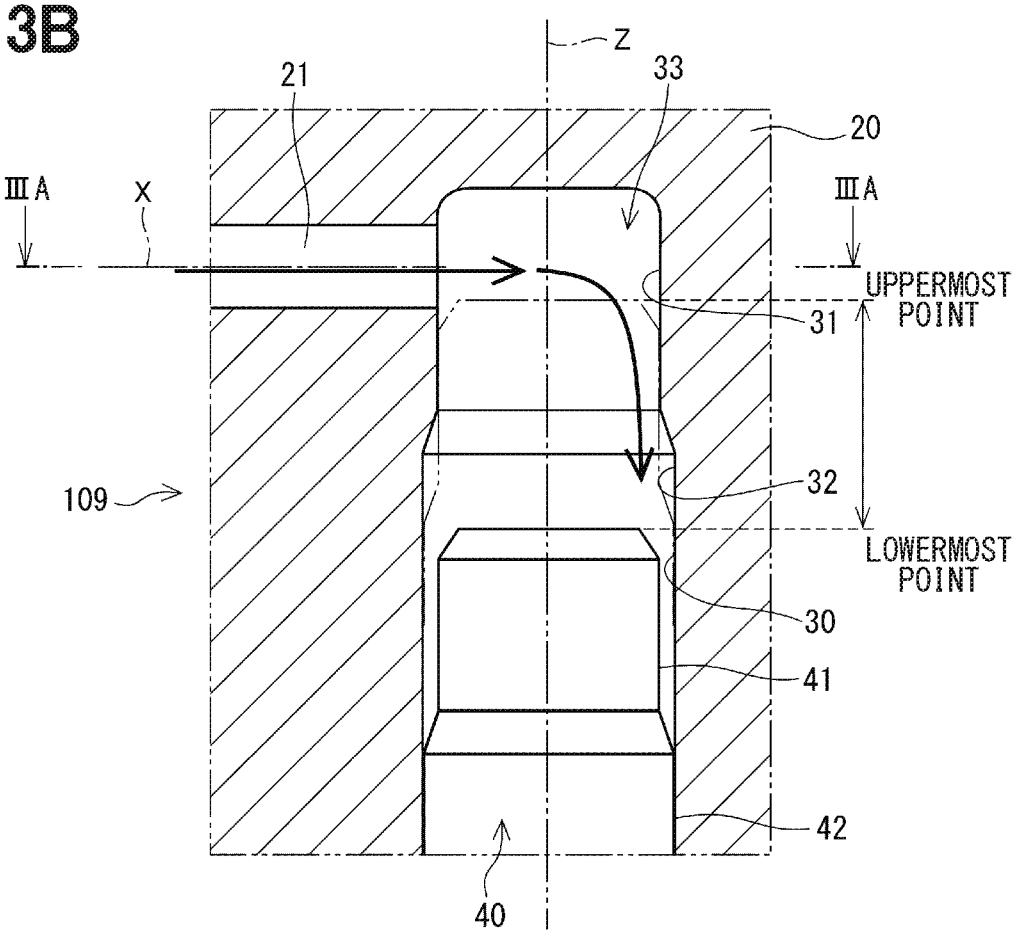
FIG. 3B is a sectional view showing the fuel injection pump taken along an axial direction of the plunger and that is an enlarged view showing an area IIIB in FIG. 2 in the comparative example.

An issue of a fuel injection pump 109 according to the comparative example will be described with reference to FIGS. 3A to 4B. FIGS. 3A and 3B are sectional views showing the intake passage 21 and the pressurizing chamber 33 taken along a radial direction and the axial direction of the plunger, respectively, when the intake valve 18 opens.

The sliding hole 30 has a step such that a first diameter part 31 has a diameter slightly smaller than that of a second diameter part 32 which occupies most of the sliding portion. The first diameter part 31 at a side of an upper bottom is communicated to the intake passage 21. The plunger 40 has a stepped shape by an upper end 41 and a main part 42. The upper end 41 has a small diameter and configured to be fitted to the first diameter part 31. The main part 42 has a large diameter and configured to slide on the second diameter part 32. In a state where the plunger 40 is placed at the uppermost point, the upper end 41 is fitted to the first diameter part 31, and a volume of the pressurizing chamber 33 is decreased. In a state where the plunger 40 is placed at the lowermost point, the upper end 41 is withdrawn from the first diameter part 31, and the volume of the pressurizing chamber 33 is increased.

In the fuel injection pump 109 in the comparative example, an axis X of the intake passage 21 is orthogonal to the plunger axis Z in each of a cross section taken along the axial direction and a cross section taken along the radial direction of the plunger 40. Therefore, in FIG. 3A which is viewed in the direction of the plunger axis Z, the axis X of the intake passage 21 and the plunger axis Z reside on the same flat plane. Furthermore, an axis of the intake valve 18 and the plunger axis Z reside on the same flat plane. The axis of the intake valve 18 is referred as to an intake valve reference axis Xo hereinafter. That is, in the fuel injection pump 109 in the comparative example, the axis X of the intake passage 21 coincides with the intake valve reference axis Xo. A discharge passage 22 is located in the cylinder 20 and communicated to the pressurizing chamber 33. The discharge passage 22 in FIG. 3A is orthogonal to the intake passage 21. However, the discharge passage 22 may be placed in various circumferential directions at which the discharge passage 22 does not interfere with the intake passage 21.

Figure 4A:
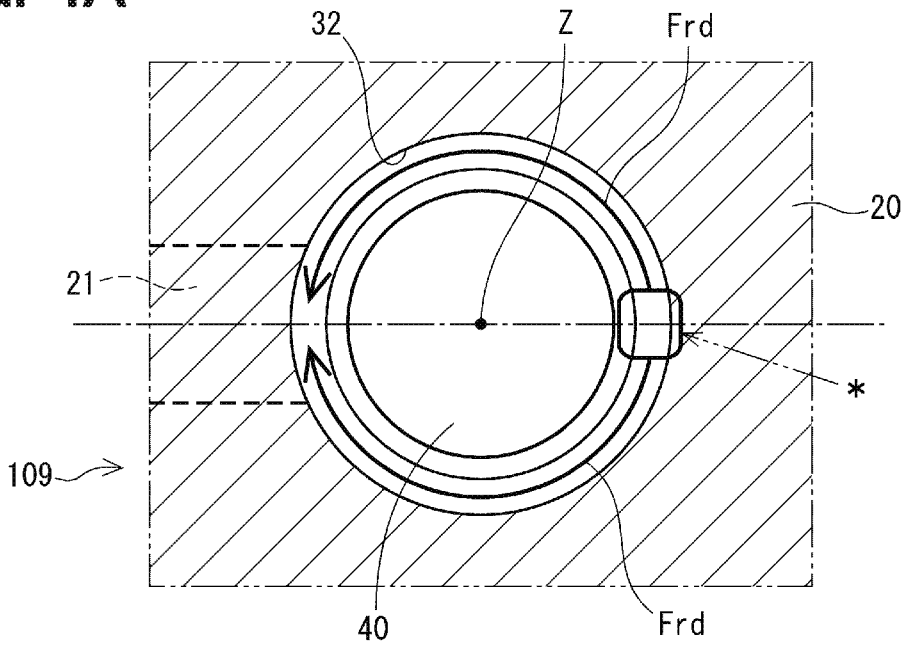
FIG. 4A is an enlarged sectional view showing the fuel injection pump taken along the radial direction of the plunger that is along a line IVA-IVA in FIG. 4B to explain local negative pressure in the comparative example.
Figure 4B:
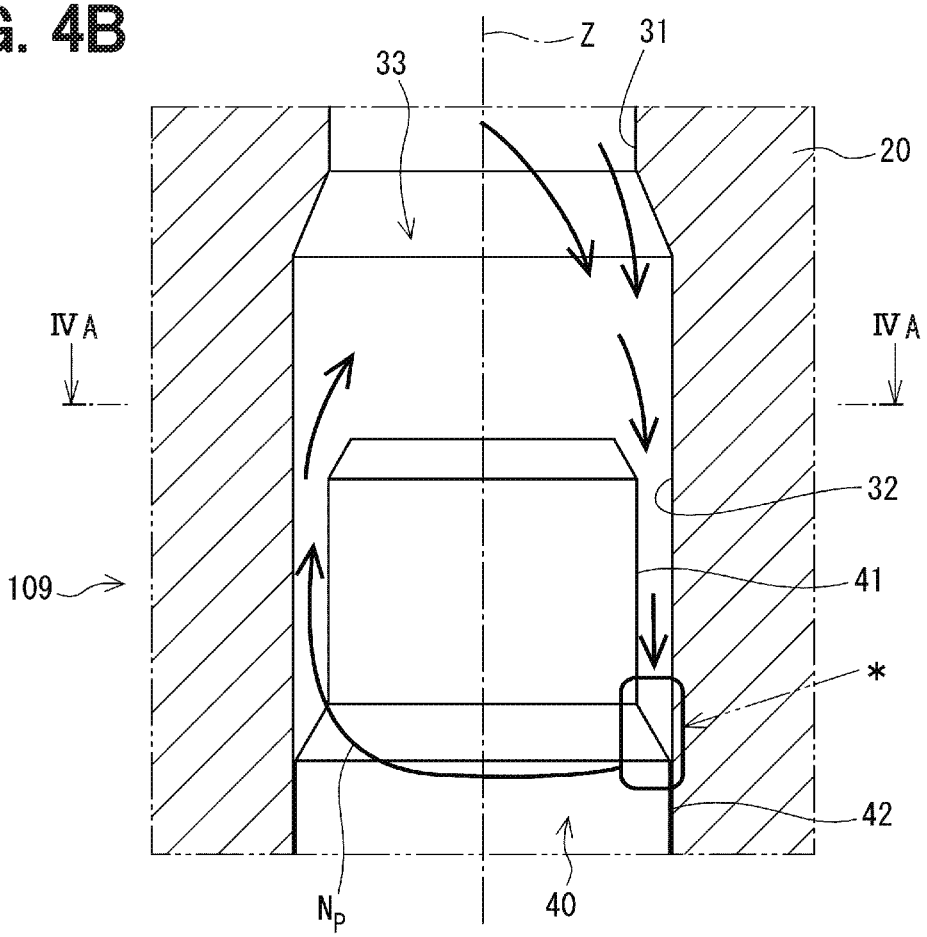
FIG. 4B is an enlarged sectional view showing the fuel injection pump taken along the axial direction of the plunger to explain the local negative pressure in the comparative example.

In this structure described above, the fuel which is inhaled from the intake passage 21 into the pressurizing chamber 33 in the fuel suction stroke, as shown by an arrow in FIG. 3B, collides to an inner wall which is opposite to the intake passage 21 and flows toward the plunger 40 along the inner wall. Accordingly, as shown in FIGS. 4A and 4B, the fuel is drawn with a pressure recovery in the upper part of the pressurizing chamber 33, and a flow of the fuel Frd which flows to surround the plunger 40 is generated. Due to this, the local negative pressure is generated around the upper end 41 of the plunger in*areas in FIGS. 4A and 4B on the side opposite to the intake passage 21 in the circumferential direction.

[Structure of Intake Passage and Pressurizing Chamber]

Therefore, in the present embodiment, it is an object to restrict the local negative pressure in the pressurizing chamber 33 in the fuel suction stroke. In the present embodiment, an arrangement of the intake passage 21 or a shape of the pressurizing chamber 33 is different from those in the comparative example.

Solution for each embodiment will be described below. A reference numeral of the fuel injection pump in each embodiment includes a number of the embodiment at the third digit with "10".

First Embodiment

A fuel injection pump 101 in a first embodiment will be described with reference to FIGS. 5A to 6C. In the first embodiment and a second embodiment, a swirl flow generating part is provided to generate a swirl flow of the fuel which is inhaled to the pressurizing chamber 33. This structure is configured to restrain the local negative pressure. In the first embodiment, the intake passage 21 is placed at a point different from the intake passage of the fuel injection pump 109 in the comparative example, and the swirl flow is generated.

Figure 5A:
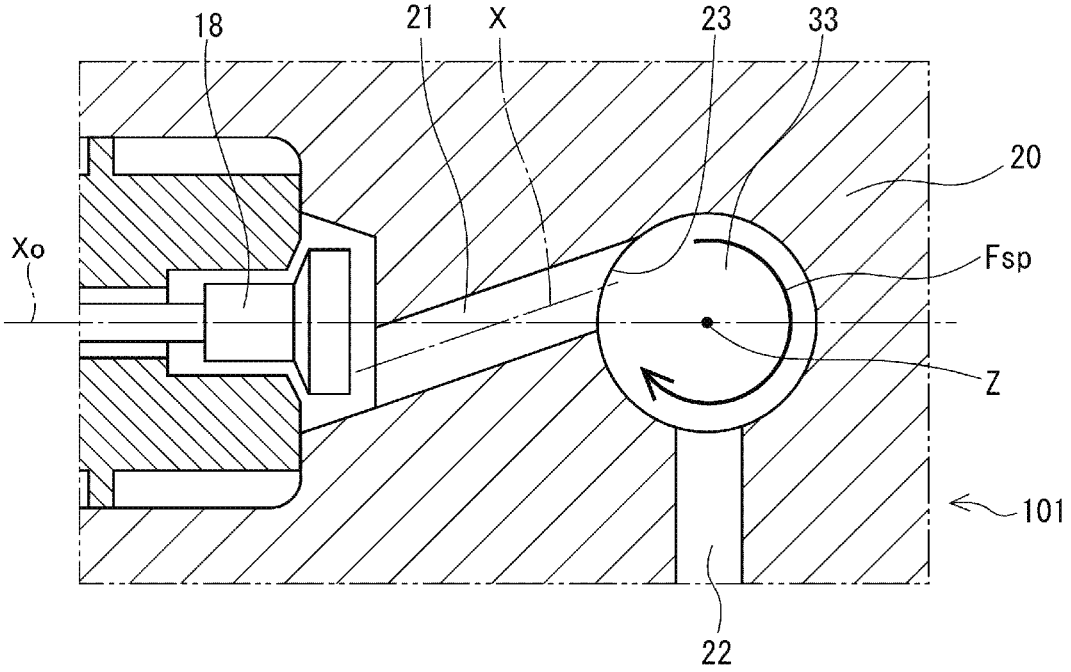
FIG. 5A is a sectional view showing a fuel injection pump taken along a radial direction of a plunger that is along a line VA-VA in FIG. 5B according to a first embodiment.
Figure 5B:
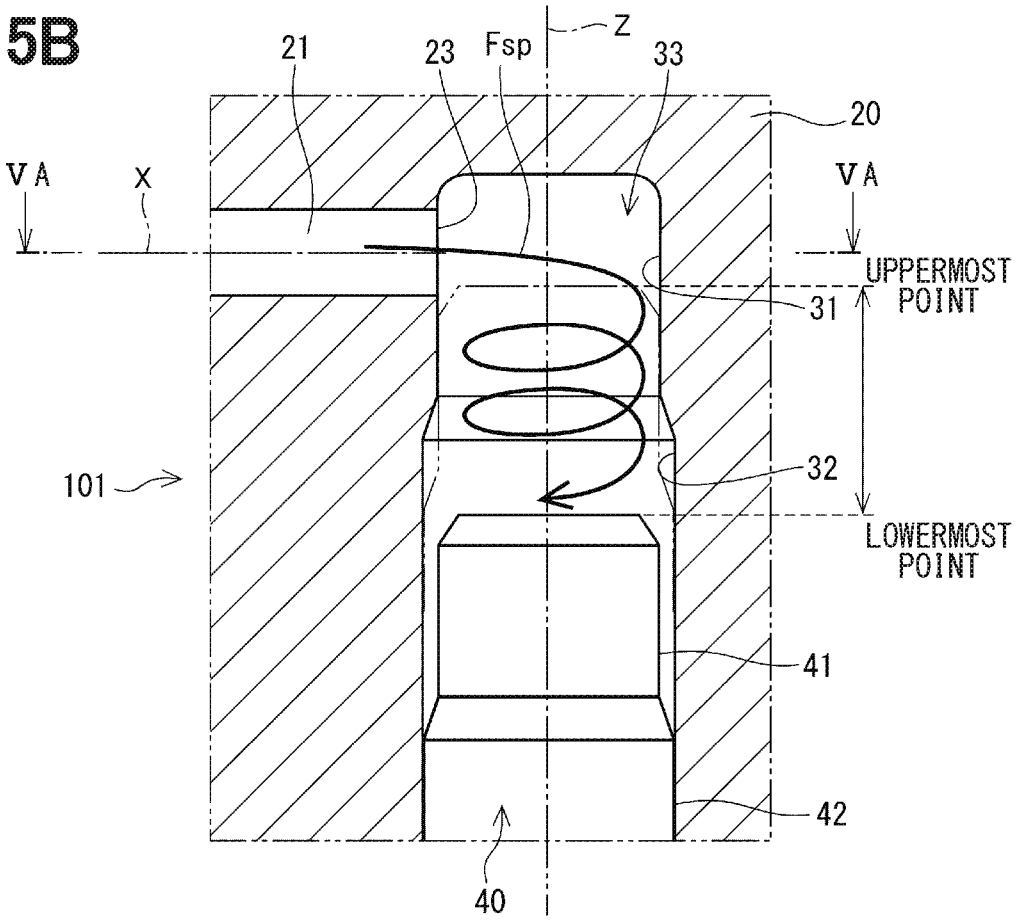
FIG. 5B is a sectional view showing the fuel injection pump taken along an axial direction of the plunger according to the first embodiment.

As shown in FIGS. 5A and 5B as an example, the fuel injection pump 101 is placed such that the axis X of the intake passage 21 is placed at a position shifted from a flat plane including the plunger axis Z. In other words, the axis X of the intake passage 21 does not reside on the same flat plane as the plunger axis Z. In addition, the intake passage 21 is not orthogonal to the inner wall of the pressurizing chamber 33 at an inlet of the intake passage 21 of the pressurizing chamber 33. That is, an eccentric inlet 23 is formed as the swirl flow generating part. The intake passage 21 intersects with the inner wall of the pressurizing chamber 33 at a non-right angle at the eccentric inlet 23.

In FIGS. 5A and 6A to 6C, similarly to FIG. 3A in the comparative example, the intake valve reference axis Xo and the plunger axis Z reside on the same flat plane. According to the example of arrangement shown in FIG. 5A, the axis X of the intake passage 21 intersects with the intake valve reference axis Xo so as to extend from the intake valve 18 toward the pressurizing chamber 33 and to be inclined away from the discharge passage 22. Therefore, as shown in FIG. 5B, the fuel which flows from the intake passage 21 into the pressurizing chamber 33 through the eccentric inlet 23 becomes a swirl flow Fsp and flows toward the plunger 40. Due to this, a generation of the flow which flows to surround the plunger 40 is restricted in the fuel when pressure is recovered in the upper area of the pressurizing chamber 33. Therefore, the local negative pressure around the upper end 41 of the plunger is restricted.

Figure 6A:
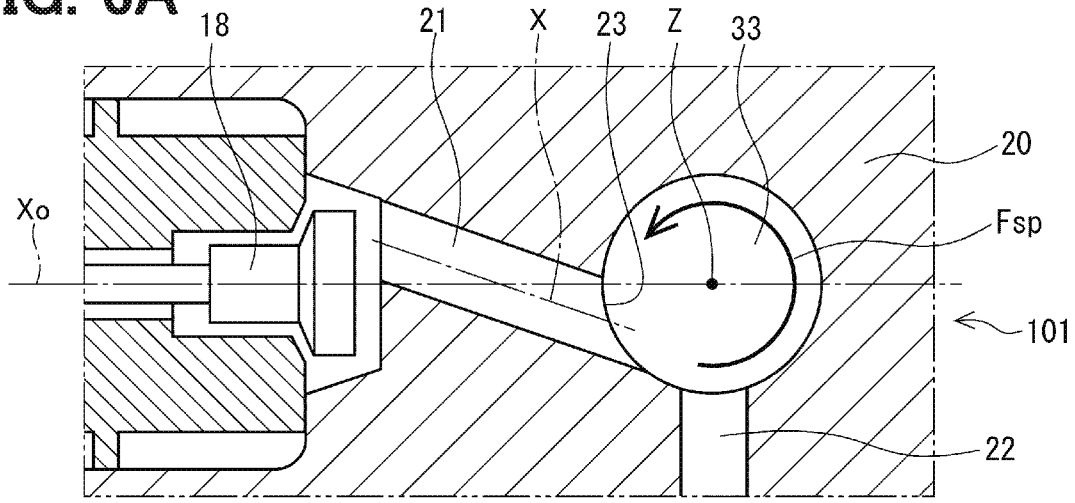
FIG. 6A is a view showing another example of an arrangement according to the first embodiment.
Figure 6B:
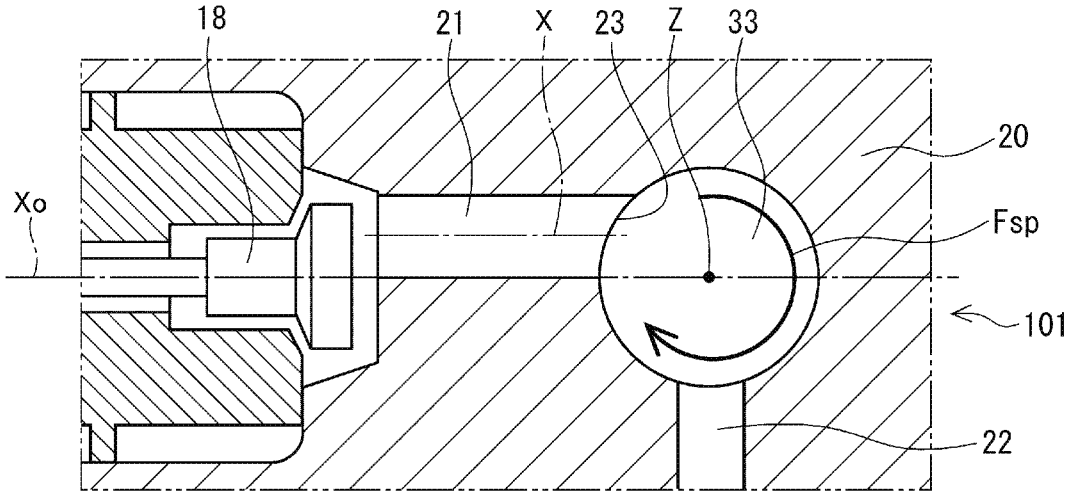
FIG. 6B is a view showing another example of the arrangement according to the first embodiment.
Figure 6C:
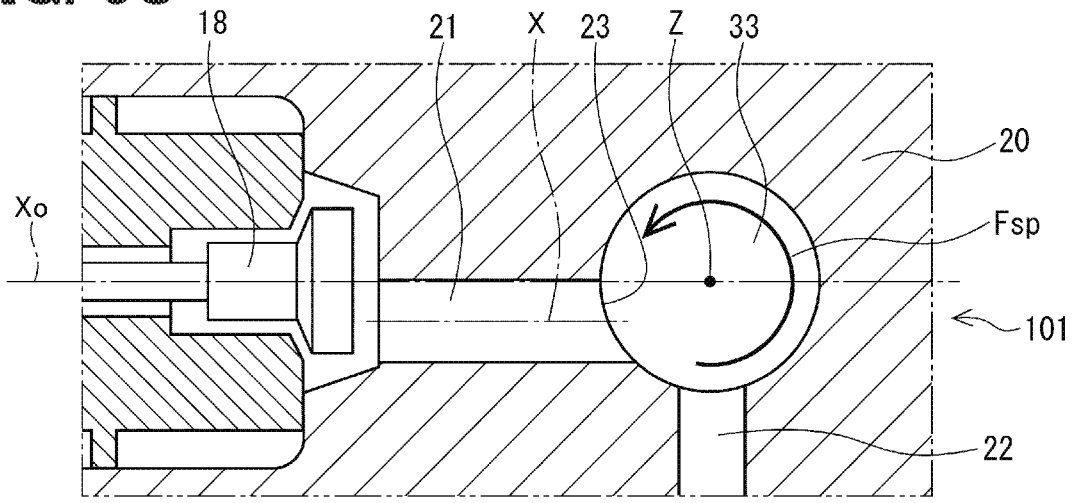
FIG. 6C is a view showing another example of the arrangement according to the first embodiment.

FIGS. 6A to 6C show other examples of arrangement of the eccentric inlet 23. According to the example of arrangement shown in FIG. 6A, the axis X of the intake passage 21 intersects with the intake valve reference axis Xo so as to extend from the intake valve 18 toward the pressurizing chamber 33 and to be inclined toward the discharge passage 22. According to the example of arrangement shown in FIG. 6B, the axis X of the intake passage 21 parallels to the intake valve reference axis Xo and is placed on the side opposite to the discharge passage 22. According to the example of arrangement shown in FIG. 6C, the axis X of the intake passage 21 parallels to the intake valve reference axis Xo and is placed closer to the discharge passage 22 than the intake valve reference axis Xo. According to the examples of the arrangement described above, the axis X of the intake passage 21 is placed on the flat plane shifted from the plane including the plunger axis Z. In addition, the intake passage 21 intersects with the inner wall of the pressurizing chamber 33 at the non-right angle at the eccentric inlet 23. Therefore, the local negative pressure which is caused by the generation of the swirl flow Fsp is restricted.

In FIGS. 5A and 6A to 6C, the axis of the intake valve 18 may not reside on the same flat plane as the plunger axis Z. In other words, the axis of the intake valve 18 may be inclined to the flat plane including the plunger axis Z or mat be offset to the flat plane including the plunger axis Z. That is, a positional relation between the axis of the intake valve 18 and the axis X of the intake passage 21 may be changed optionally. Therefore, the example of arrangement in FIG. 5A is not essentially different from the example of arrangement in FIG. 6B. In addition, the example of arrangement in FIG. 6A is not essentially different from the example of arrangement in FIG. 6C.

Second Embodiment

A fuel injection pump 102 in a second embodiment will be described with reference in FIGS. 7A to 9. A structure of the swirl flow generating part in the second embodiment is different from that in the first embodiment. As one example shown in FIGS. 7A and 7B, the fuel injection pump 102 includes at least one inner wall recess 25 as the swirl flow generating part. The inner wall recess 25 is located in a part of the inner wall of the pressurizing chamber 33 in the circumferential direction and recessed outward in the radial direction. The inner wall recess 25 is placed at a position asymmetric with respect to the axis X of the intake passage 21 when viewed in the direction of the plunger axis Z. For example, the inner wall recess 25 is formed by recessing a specified point after the inner wall is formed in a circular shape.

The configuration guides the fuel flowing from the intake passage 21 to the pressurizing chamber 33 to flow toward the inner wall recess 25. Therefore, the swirl flow Fsp is generated. In this way, similarly to the first embodiment, the local negative pressure is restricted.

Figure 7A:
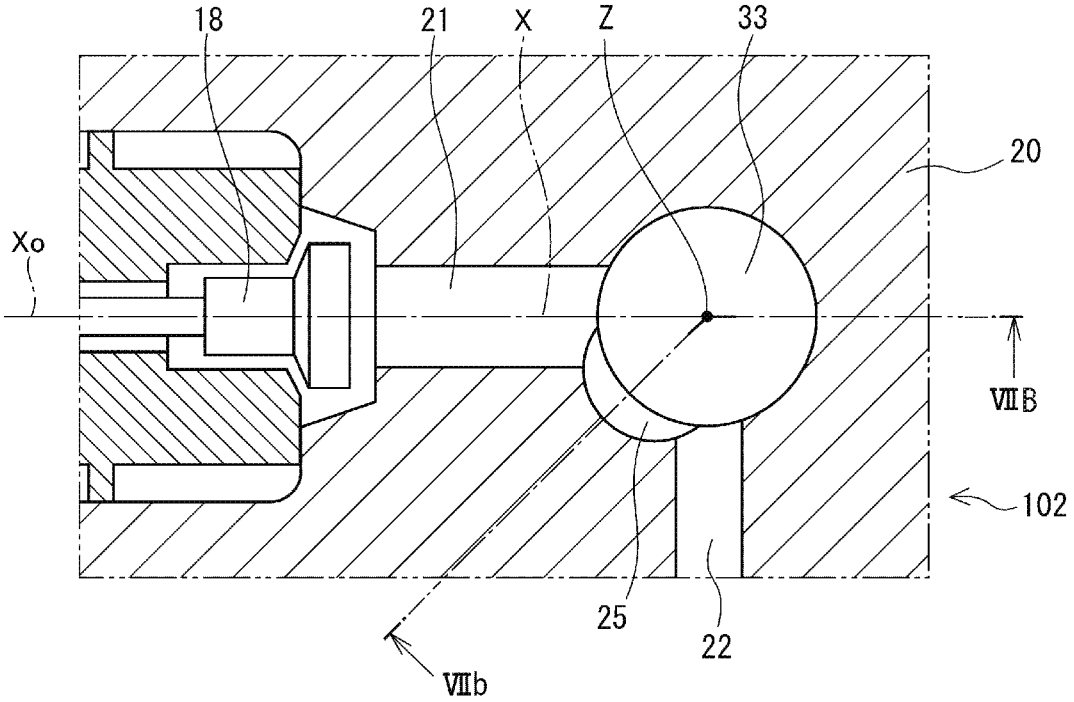
FIG. 7A is a sectional view showing a fuel injection pump taken along a radial direction of a plunger that is along a line VIIA-VIIA in FIG. 7B according to a second embodiment.
Figure 7B:
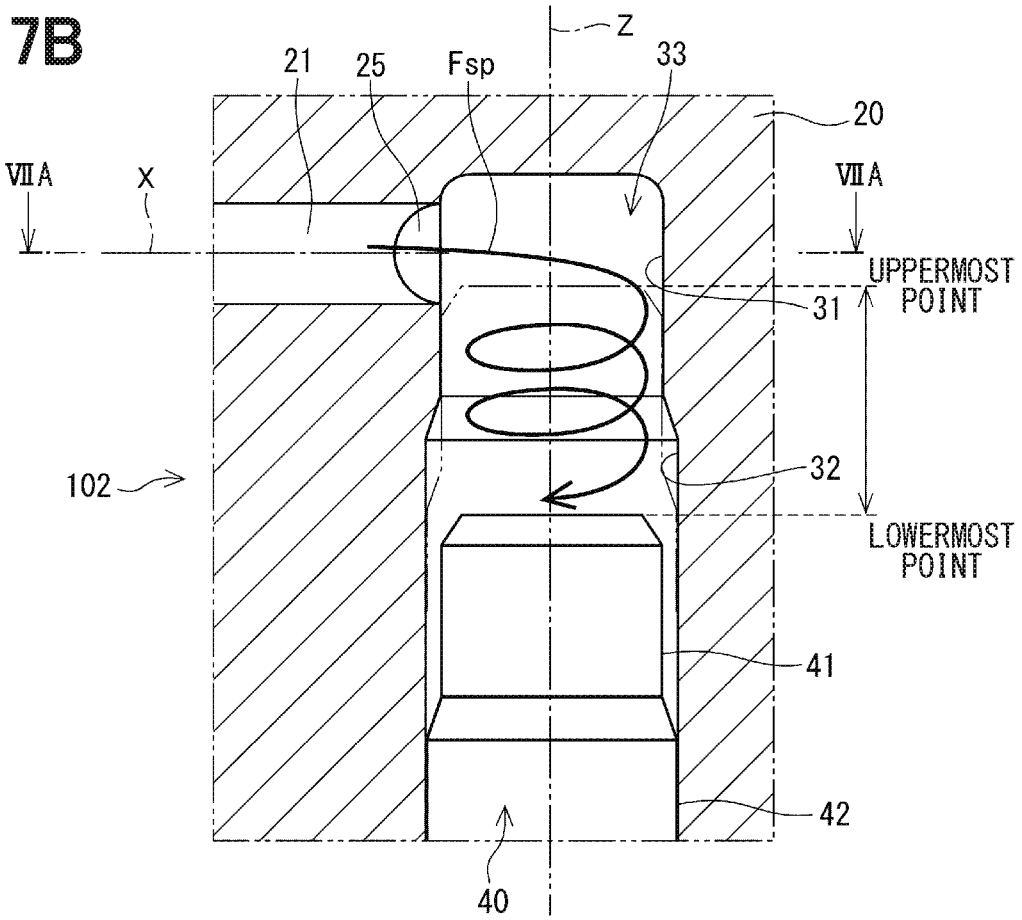
FIG. 7B is a sectional view showing the fuel injection pump taken along an axial direction of the plunger according to the second embodiment.

In the example shown in FIG. 7A, the inner wall recess 25 is closer to the discharge passage 22 than the axis X of the intake passage 21. The inner wall recess 25 overlaps both the discharge passage 22 and the intake passage 21. At least a part of the inner wall recess 25 overlaps the intake passage 21. This configuration guides the fuel immediately after flowing into the pressurizing chamber 33 to flow. Therefore, this configuration is effective to generate the swirl flow Fsp at an initial stage of the intake especially around the uppermost point the plunger 40.

Figure 8A:
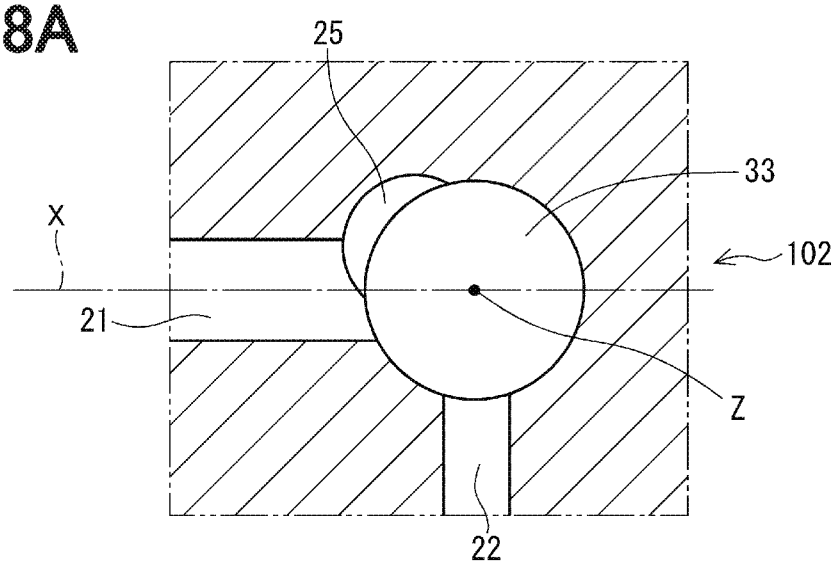
FIG. 8A is a view showing another example of an arrangement according to the second embodiment.
Figure 8B:
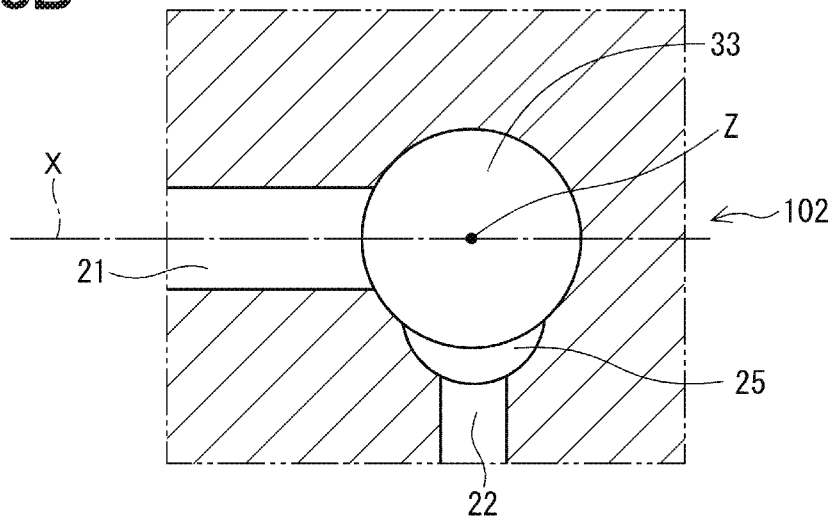
FIG. 8B is a view showing another example of the arrangement according to the second embodiment.
Figure 8C:
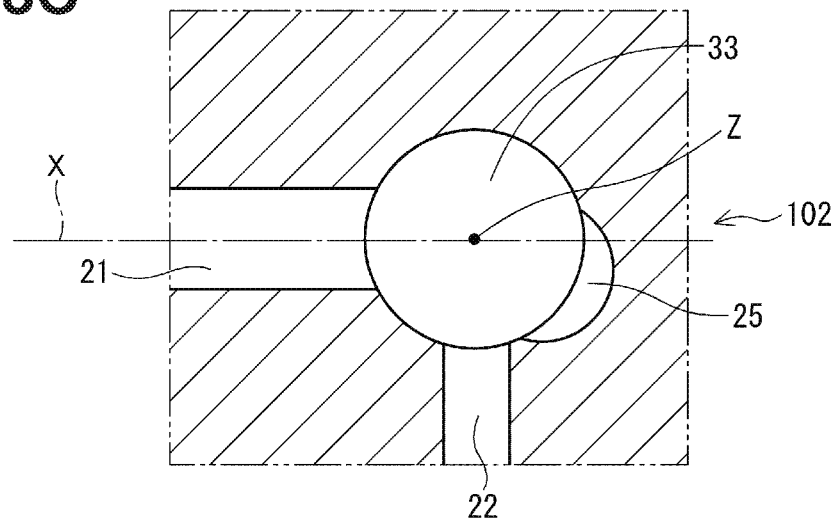
FIG. 8C is a view showing another example of the arrangement according to the second embodiment.

FIGS. 8A to 8C show other examples of arrangement of the inner wall recess 25. The inner wall recess 25 in FIG. 8A is placed on the side opposite to the discharge passage 22 with respect to the axis X of the intake passage 21. The inner wall recess 25 is overlapped with the intake passage 21 while not overlapped with the discharge passage 22. The inner wall recess 25 in FIG. 8B is overlapped with the discharge passage 22 while not overlapped with the intake passage 21. The inner wall recess 25 in FIG. 8C is not overlapped with both the intake passage 21 and the discharge passage 22 and placed at a position asymmetrical with respect to the axis X of the intake passage 21 when viewed in the direction of the plunger axis Z. In another example, the inner wall recess 25 may be provided at two or more places of the inner wall of the pressurizing chamber 33.

In the examples of the arrangement which are described above, the local negative pressure due to the generation of the swirl flow Fsp is restricted. In the example shown in FIG. 8A, similarly to the example shown in FIG. 7A, at least a part of the inner wall recess 25 is overlapped with the intake passage 21. This configuration is effective to generate the swirl flow Fsp at the initial stage of the intake around the uppermost point of the plunger 40.

Figure 9:
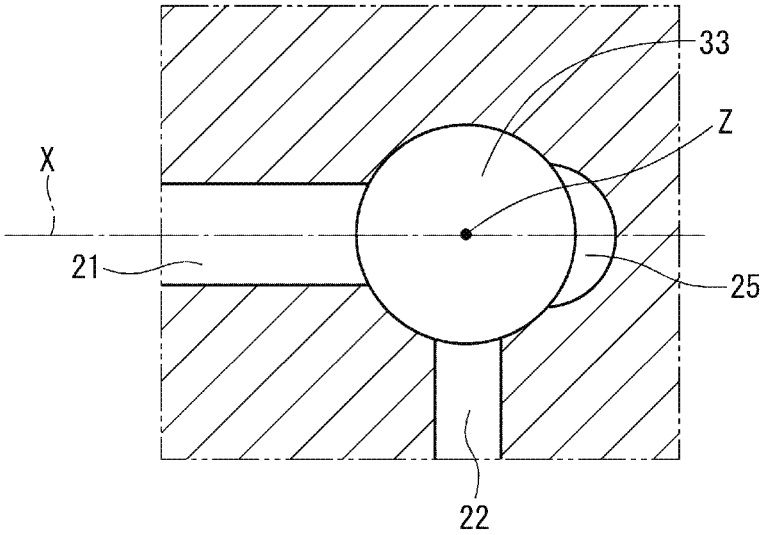
FIG. 9 is a view showing an example of an arrangement of an inner wall recess which is excluded from the second embodiment.

FIG. 9 shows an example of the arrangement of the inner wall recess 25. The example shown in FIG. 9 is excluded from the second embodiment. In FIG. 9, the inner wall recess 25 is on the axis X of the intake passage and opposed to the intake passage 21. That is, the inner wall recess 25 is placed at a position symmetrical with respect to the axis X of the intake passage 21. In this arrangement, fuel flows from the intake passage 21 and causes an anti-clockwise flow and a clockwise flow that are cancelled to each other not to generate the swirl flow Fsp. Therefore, this arrangement is excluded as inappropriate. In addition, in a case where the inner wall recess 25 is located at two or more positions, the inner wall recess 25 is required to be placed at a position asymmetric with respect to the axis X of the intake passage 21.

Third Embodiment

Figure 10A:
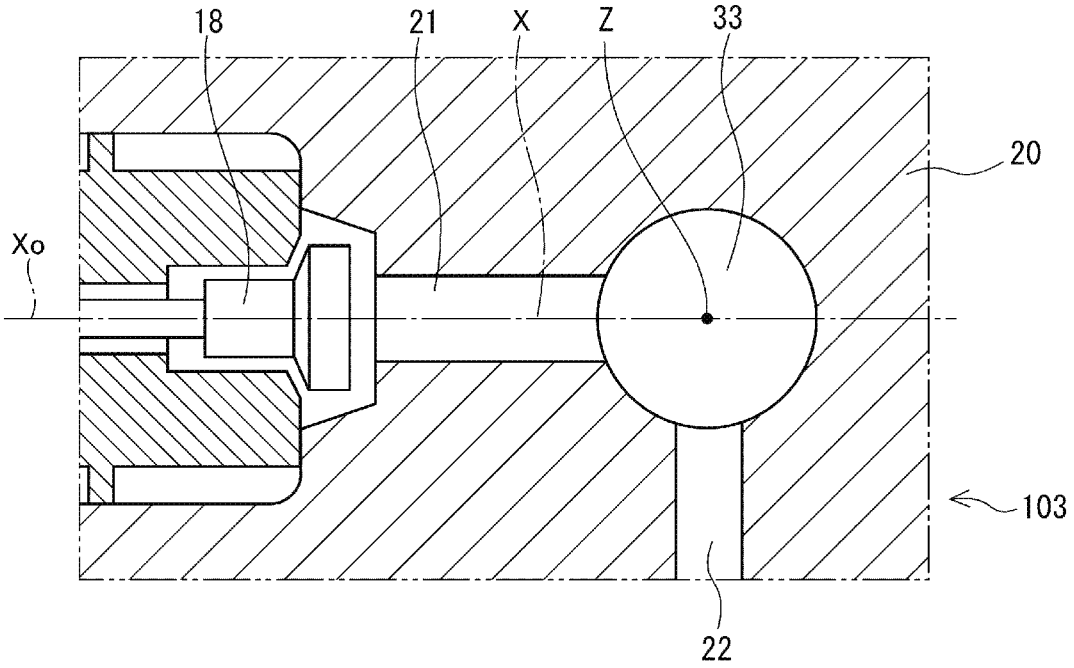
FIG. 10A is a sectional view showing a fuel injection pump taken along a radial direction of a plunger that is along a line XA-XA in FIG. 10B in a third embodiment.
Figure 10B:
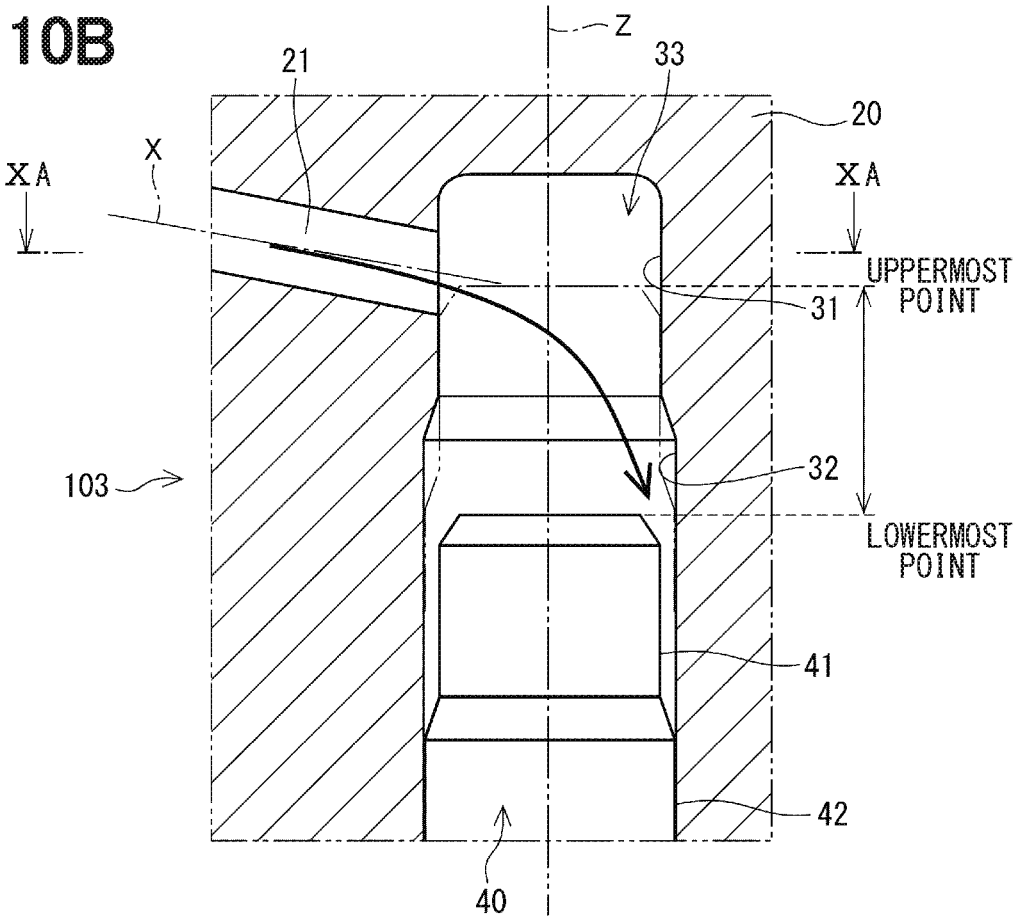
FIG. 10B is a sectional view showing the fuel injection pump taken along an axial direction of the plunger in the third embodiment.

A fuel injection pump 103 in a third embodiment will be described with reference in FIGS. 10A and 10B. In the third embodiment, the local negative pressure in the pressurizing chamber 33 in the fuel suction stroke is restrained by a configuration different from the swirl flow generating part in the first or the second embodiment. As shown in FIG. 10B, the axis X of the intake passage 21 extends from the outside of the pressurizing chamber 33 in the radial direction toward the plunger axis Z and inclines toward the lowermost position of the plunger 40. On the other hand, as shown in FIG. 10A, the axis X of the intake passage 21 in the cross section taken along the radial direction and the plunger axis Z may reside on the same flat plane. Similarly to FIGS. 5A to 6C in the first embodiment, the axis X of the intake passage 21 may be arranged on a flat plane shifted from the flat plane including the plunger axis Z.

In the third embodiment, fuel which is inhaled from the intake passage 21 into the pressurizing chamber 33 directly flows around the upper end 41 of the plunger on the side opposite to the intake passage 21. Therefore, fuel which is drawn from the upper part is balanced with fuel which is supplied newly, and the local negative pressure may be restricted. In a case where the third embodiment is combined with the first embodiment, synergetic effect with a swirl flow generating operation by the eccentric inlet 23 may be obtained.

Figure 11:
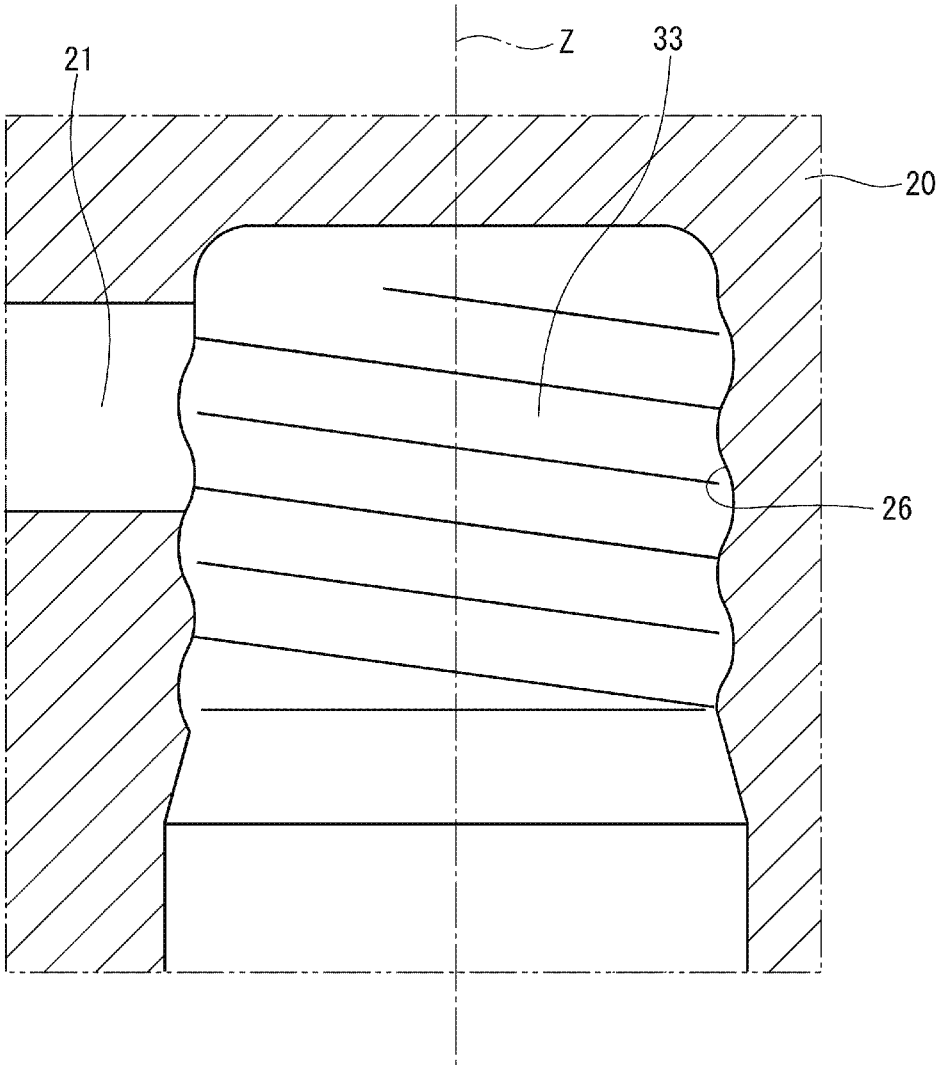
FIG. 11 is an enlarged sectional view taken along a plunger axis in another embodiment.

Another Embodiment (a) As shown in FIG. 11, a helical recessed groove 26 may be formed on the inner wall of the pressurizing chamber 33 as the swirl flow generating part which is different from the eccentric inlet 23 in the first embodiment or the inner wall recess 25 in the second embodiment. The helical recessed groove 26 can be construed that the inner wall recess 25 in the second embodiment is formed continually. Therefore, the axis of the intake passage 21 and the plunger axis Z may reside on the same flat plane, or the axis of the intake passage 21 may reside on a flat plane shifted from the flat plane including the plunger axis Z. Fuel is inhaled into the pressurizing chamber 33, and the flow of the fuel becomes rotation flow along the helical recessed groove 26.

Figure 12A:
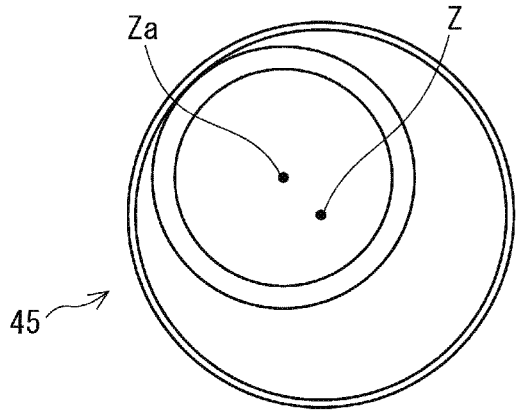
FIG. 12A is a top view showing a plunger viewed along an arrow XIIA in FIG. 12B in another embodiment.
Figure 12B:
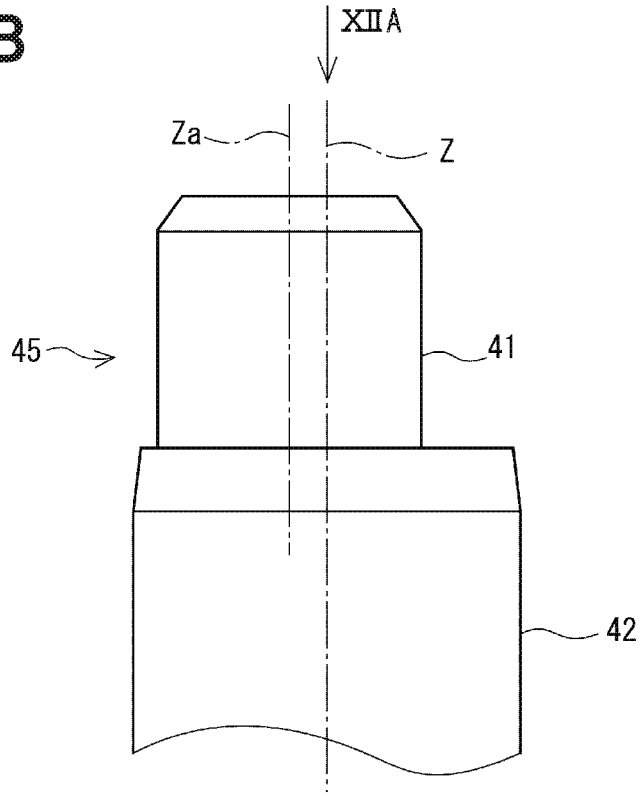
FIG. 12B is a front view showing the plunger in another embodiment.

(b) In the first or the second embodiment, the swirl flow generating part is provided in the cylinder 20. However, the swirl flow generating part may be provided in the plunger. As shown in FIGS. 12A and 12B, an axis Za of an upper end 41 of a plunger 45 may be eccentric to an axis Z of the main part 42.

(c) The driving mechanism of the plunger 40 may be not only the mechanism which uses the return spring and the cam as shown in FIG. 2, but also another driving mechanism which uses an actuator or the like. Furthermore, the fuel injection pump in the present disclosure may be used for another purpose other than the diesel engine.

While the present disclosure has been described with reference to preferred embodiments thereof, it is to be understood that the disclosure is not limited to the preferred embodiments and constructions.

What is claimed is:

1. A fuel injection pump comprising:

a cylinder;

a plunger configured to slide along an inner wall of a sliding hole located in the cylinder and to reciprocate between an uppermost point and a lowermost point to pressurize the fuel in a pressurizing chamber placed at an end of the sliding hole at a highest point;

an intake valve provided at an upstream of the pressurizing chamber and configured to be controlled to open and close; and an intake passage communicating the intake valve to the pressurizing chamber, wherein the plunger is movable downward to cause the pressurizing chamber to inhale the fuel from the intake passage in a fuel suction stroke, and the intake passage is communicated to the pressurizing chamber at a lateral side of a plunger axis that is an axis of the plunger in a sliding direction, the fuel injection pump further comprising:

a swirl flow generating part configured to guide the fuel to form a swirl flow around the plunger axis in the fuel suction stroke, the intake valve has an intake valve reference axis, the intake valve reference axis and the plunger axis reside on a same flat plane, and an axis of the intake passage intersects with the intake valve reference axis.

2. The fuel injection pump according to claim 1, wherein the intake passage intersects with the inner wall of the pressurizing chamber at a non-right angle at an eccentric inlet, and the eccentric inlet is formed as the swirl flow generating part.

3. The fuel injection pump according to claim 1, wherein the plunger includes an upper end and a main part, which is larger in diameter than the upper end, the upper end and the main part form a stepped shape, the sliding hole includes a first diameter part and a second diameter part, which form a stepped shape, the first diameter part is communicated to the intake passage, the plunger main part is slidable relative to the second diameter part, and the upper end is configured to be fitted to the first diameter part.

4. The fuel injection pump according to claim 1, wherein the intake passage is non-orthogonal to an inner wall of the pressurizing chamber at an inlet of the intake passage of the pressurizing chamber.

* * * * *